US007472856B2

(12) United States Patent
Shears

(10) Patent No.: US 7,472,856 B2
(45) Date of Patent: Jan. 6, 2009

(54) PILL CRUSHER

(76) Inventor: W. Allan Shears, 411 S. Third St., Divernon, IL (US) 62530

( * ) Notice: Subject to any disclaimer, the term of this patent is extended or adjusted under 35 U.S.C. 154(b) by 0 days.

(21) Appl. No.: 11/349,602

(22) Filed: Feb. 8, 2006

(65) Prior Publication Data

US 2007/0181724 A1 Aug. 9, 2007

(51) Int. Cl.
*B02C 18/30* (2006.01)

(52) U.S. Cl. ..... 241/285.2; 241/DIG. 27

(58) Field of Classification Search ..... 241/285.1, 241/285.2, 168, 169.1, DIG. 27, 243, 194, 241/100
See application file for complete search history.

(56) References Cited

U.S. PATENT DOCUMENTS

| | | | | | |
|---|---|---|---|---|---|
| 2,068,450 | A | * | 1/1937 | Eberly | 241/243 |
| 2,398,932 | A | * | 4/1946 | Grant | 241/100 |
| 2,482,279 | A | * | 9/1949 | Lemmon et al. | 241/186.3 |
| 4,366,930 | A | | 1/1983 | Trombetti, Jr. | |
| 4,765,549 | A | | 8/1988 | Sherman | |
| 4,887,755 | A | | 12/1989 | Gibilisco | |
| 5,067,666 | A | | 11/1991 | Sussman | |
| 5,148,996 | A | * | 9/1992 | Fletcher et al. | 241/36 |
| 5,155,975 | A | * | 10/1992 | Knowler | 53/513 |
| 5,531,386 | A | | 7/1996 | Jensen | |
| 5,595,348 | A | * | 1/1997 | Barone | 241/36 |
| 5,913,484 | A | * | 6/1999 | Kurtz | 241/73 |
| 6,508,424 | B1 | | 1/2003 | Marshall | |
| 6,837,453 | B2 | * | 1/2005 | Sturm | 241/243 |
| 7,121,487 | B2 | * | 10/2006 | Cohen et al. | 241/79.3 |
| 2005/0127218 | A1 | | 6/2005 | Demske et al. | |
| 2005/0133645 | A1 | | 6/2005 | Janzen | |

FOREIGN PATENT DOCUMENTS

| | | | |
|---|---|---|---|
| JP | 59151924 | * | 8/1984 |

* cited by examiner

*Primary Examiner*—Faye Francis
(74) *Attorney, Agent, or Firm*—Law Office of Robert M. Patino

(57) ABSTRACT

A removable pill crusher assembly for grinding pellets into grinds in a transportable housing is provided that is easy to operate, transportable and prevents cross contamination of medication. The removable pill crusher includes a hopper for receiving the pellets, a latching lid for securing the pellets in said hopper during operational usage, an at least one striking hammer positioned to strike the pellets when rotated through the hopper and a shaft for transporting the grinds from the hopper to a collection bin, where the collection bin is located at a bottom end of the shaft where the grinds are collectable within, creating a confined region and safe operation.

18 Claims, 8 Drawing Sheets

PILL CRUSHER

BACKGROUND OF THE INVENTION

The present invention relates to a removable pill crusher assembly for a transportable housing used to crush pellets and like objects into grinds, and more particularly to such a removable pill crusher assembly used interchangeably between transportable housings and prevents contamination of grinds from one removable pill crusher assembly to another removable pill crusher assembly.

Pills are a common means of administering medication or vitamins orally and are a convenient means of assigning and taking required dosages for a particular ailment or disease. Solid pills are sometimes the only means of obtaining a required medication because pharmaceutical companies may only produce certain drugs that are available in a tablet form or alternative states such as a solution are expensive or impractical to take. Crushing or grinding pills has become a necessity for children and adults who are incapable or have difficulty swallowing pills whole. Animals that need medication routinely require capsules or tablets to be crushed or grinded to have the contents of the tablets administered orally. Placing the grinds or powder of crushed pills into food or a liquid allows a person or animal to more easily take medication or vitamins orally. For certain persons, ingesting a crushed pill is the only means of taking a medication because they are unable to physically swallow a pill whole.

Traditional means of crushing or grinding pills into a powder-like form required the use of a mortar and pestle. Frequently, nurses often resort to a hammer to smash the pills in a bowl type container that would result in the remnants frequently flying out of the bowl type container. The reduction of necessary dosages would become a problem because of lost powder or grinds. Both these techniques required a significant amount of force exerted from the user to achieve the desired pill crushing effect. The hammer method in particular creates loud noises that often irritate the user or nearby persons and animals. Furthermore, the crushing tool and the crushing container need to be washed thoroughly after use to prevent contamination of medications. Additionally, this equipment would need to be dried thoroughly to prevent the powder or grinds from becoming sticky. The activity required to prevent cross contamination of pill residue is very laborious and demands extra hours for caregivers that could better be served attending their patients or animals.

Alternative electrical powered designs do exist that eliminate manual crushing means, but each have their own short comings. U.S. Pat. No. 5,067,666 discloses a ramming means of crushing pills into powder using a motor. The drawback to this action is that it depends on a tight fit between a ram and a guide shaft. If the desired crushing effect does not occur on the first pass, the user will not have a second opportunity to crush the pill further. The operation also depends on batteries to power the motor; however, the batteries will eventually die and the user will be forced to change the batteries. U.S. Pat. No. 5,531,386 discloses an impact hammer powered by energy stored in a spring; however, the means of collecting the resulting powder is provided by an envelope. The user must then pour the collected powder into a cup by folding the envelope and tilting on end downward. This activity requires the operator of the device to be extremely cautious when transporting the powder. U.S. Pat. App. No. 2005/0127218 discloses a pill crusher utilizing a series of rollers in conjunction with a pressure plate. This design depends on interlocking gears that propel a pill and its remnants in a downward direction. The system does not have a fail safe mechanism to deal with stubborn pills that might jam the operation, causing the gears to stall and damaging the motor.

Therefore, it is desired to have a pill crusher assembly that is electrically operated for ease of usage. Furthermore, it is desired that this electrical operation is mobile such that a housing containing the electrical motor is transportable from room to room without a great deal of inconvenience. A rechargeable mechanism to power up the power supply is also desired to reduce waste associated with used batteries. Additionally, the pill crusher assembly is desired to be exchangeable such that multiple pill crusher assemblies may be used with the same housing unit to eliminate concerns associated with cross contamination. The crushing device is preferred to be provided with a fail safe mechanism to prevent locking or disruption associated with the grinding action such that damage does not occur to the motor or grinding devices. Moreover, it is desirable to have a pill crusher assembly that is capable of depositing the crushed residue of the pill into a cup safely and securely to avoid mishaps related to transporting the powder-like material into an ingestible food or liquid.

Thus, there is a need for a pill crusher assembly capable of grinding pills or pellets into a powder-like form or small particles that has a simple mechanical operation to reduce cost and maintenance. The pill crusher assembly needs to be small enough to fit into a transportable housing that carries a motor. Furthermore, there is a need for such a pill crusher assembly that is exchangeable such that a pill crusher assembly may be specifically elected for a particular medication or patient to prevent cross-contamination. There is also a need to have a pill crusher assembly that provides a safe and secure means of depositing the crushed residue of a pill or pellet into a cup for dispensing the powder-like material.

BRIEF SUMMARY OF THE INVENTION

The above-identified needs are addressed by the present pill crusher assembly for grinding pellets into grinds in a sealed environment. One feature of the present invention is the ability to be removable and interchanged with other compatible pill crusher assemblies so that one housing may be used for multiple pill crusher assemblies. The pill crusher assembly's small size, cheap construction costs, and durability offer a user the advantage of using one pill crusher assembly per medication without the worries of cross-contaminating medications. Using the pill crusher assembly in conjunction with a transportable housing makes the operation simple and hassle free.

Another feature of the present invention is a hopper for receiving pellets that is provided with a means of grinding the pellets while the pellets reside in said hopper. The means of grinding the pellets transforms the pellets into grinds with a pivotal striking action originating outside of the hopper. In the preferred embodiment, multiple striking hammers are used to pivotally strike pellets or pills residing in the hopper through an at least one gap for accommodating an at least one striking hammer to break the pellets or pills apart. After the pellets or pills have been pulverized into a powder or grind-like form (collectively referred to as "grinds"), the grinds of the pill crusher assembly are transferred down a shaft and into a collection bin located at a bottom end of the shaft. An optional safety mechanism may be employed to ensure that the pill crusher assembly is adequately aligned to begin operation so that the risk of losing grinds is minimized.

More specifically, a pill crusher assembly for grinding pellets into grinds in a sealed environment is removable to allow multiple pill crusher assemblies to be used in a single housing. A hopper for receiving pills or pellets is provided that is sealed shut with a latching lid for securing the pellets inside the hopper during operational usage. A means of grinding the pellets while the pellets reside in the hopper is also included that transforms the pellets into grinds with a pivotal striking action originating outside of the hopper. The pill crusher assembly is further provided with a shaft for transporting the grinds from the hopper to a collection bin resides below the hopper. The collection bin is located at a bottom end of the shaft where the grinds are collectable within.

In another embodiment, a removable pill crusher assembly for grinding pellets into grinds in a sealed environment includes a transportable housing. In the preferred embodiment, the transportable housing further includes a rechargeable power supply for powering a small electric motor that drives a means of grinding the pellets while the pellets reside in a hopper. The hopper is positionable inside the transportable housing for receiving pellets and includes a latching lid for securing the pellets in said hopper during operational usage. The means of grinding the pellets transforms the pellets into grinds with a pivotal striking action originating outside of said hopper. A shaft for transporting the grinds from said hopper to a collection bin, said collection bin is located at a bottom end of said shaft where the grinds are collectable within.

In an additional embodiment, a removable pill crusher assembly for grinding pellets into grinds in a sealed environment includes a transportable housing and a safety mechanism. The safety mechanism restricts operational usage of the pill crusher assembly when the pill crusher assembly is in a disengaged position. A hopper is positionable inside the transportable housing for receiving pellets and the latching lid is used for securing the pellets in the hopper during operational usage. An at least one striking hammer is positioned to strike the pellets when rotated through an at least one gap in the hopper, the at least one striking hammer transforms the pellets into grinds when the removable pill crusher assembly is in operation. A shaft for transporting the grinds from the hopper to a collection bin is further provided where the collection bin is located at a bottom end of the shaft where the grinds are collectable within.

DETAILED DESCRIPTION OF THE INVENTION

Figure 1:
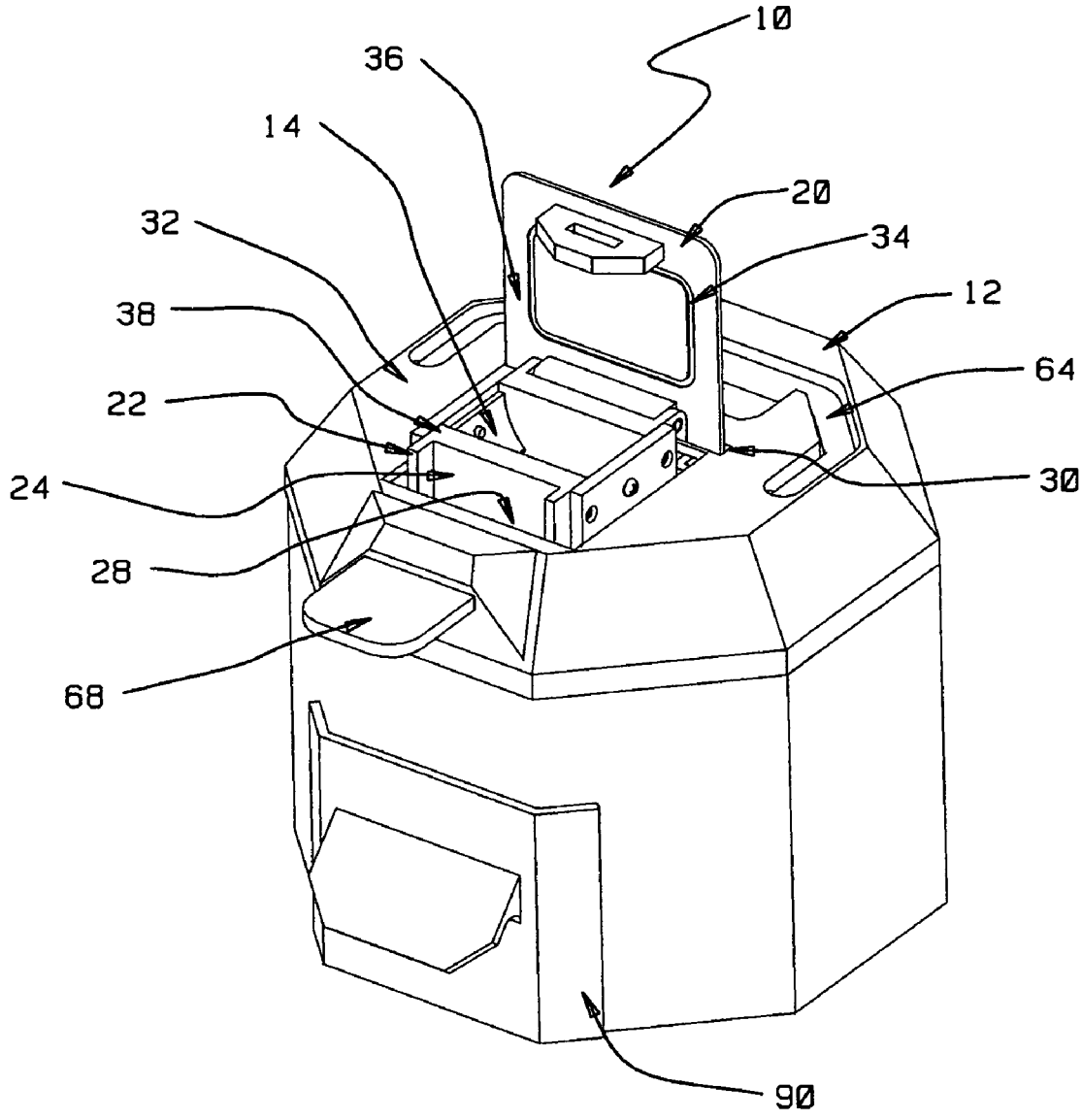
FIG. 1 is a top perspective view of a pill crusher assembly in a transportable housing in an open position.

Referring now to FIGS. 1, a pill crusher assembly for grinding pellets or pills into grinds in a sealed environment is generally designated 10. The removable pill crusher assembly 10 is designed for being receivable in a transportable housing 12 and is preferably removable such that multiple pill crusher assemblies may be used for a single transportable housing 12.

Now referring to FIGS. 1, 2, 3, 4 and 7, the pill crusher assembly 10 is provided with a hopper 14 for receiving pellets 16. The hopper 14 is situated on an upper end 18 of the pill crusher assembly 10 and is preferably provided with a latching lid 20 for securing the pellets 16 in the hopper 14 during operational usage. The latching lid 20 is attached pivotally to the pill crusher assembly 10. In the most preferred embodiment, a plurality of guide ribs 22 is located exterior of an at least one bearing plate 24 for ensuring accurate positioning of the pill crusher assembly 10 in the transportable housing 12. The guide ribs 26 follow a corresponding crusher assembly guide 27 that acts as a channel for each guide rib to provide an easy means of sliding the pill crusher assembly 10 in and out of a pill crusher assembly receiving cavity 28.

Figure 2:
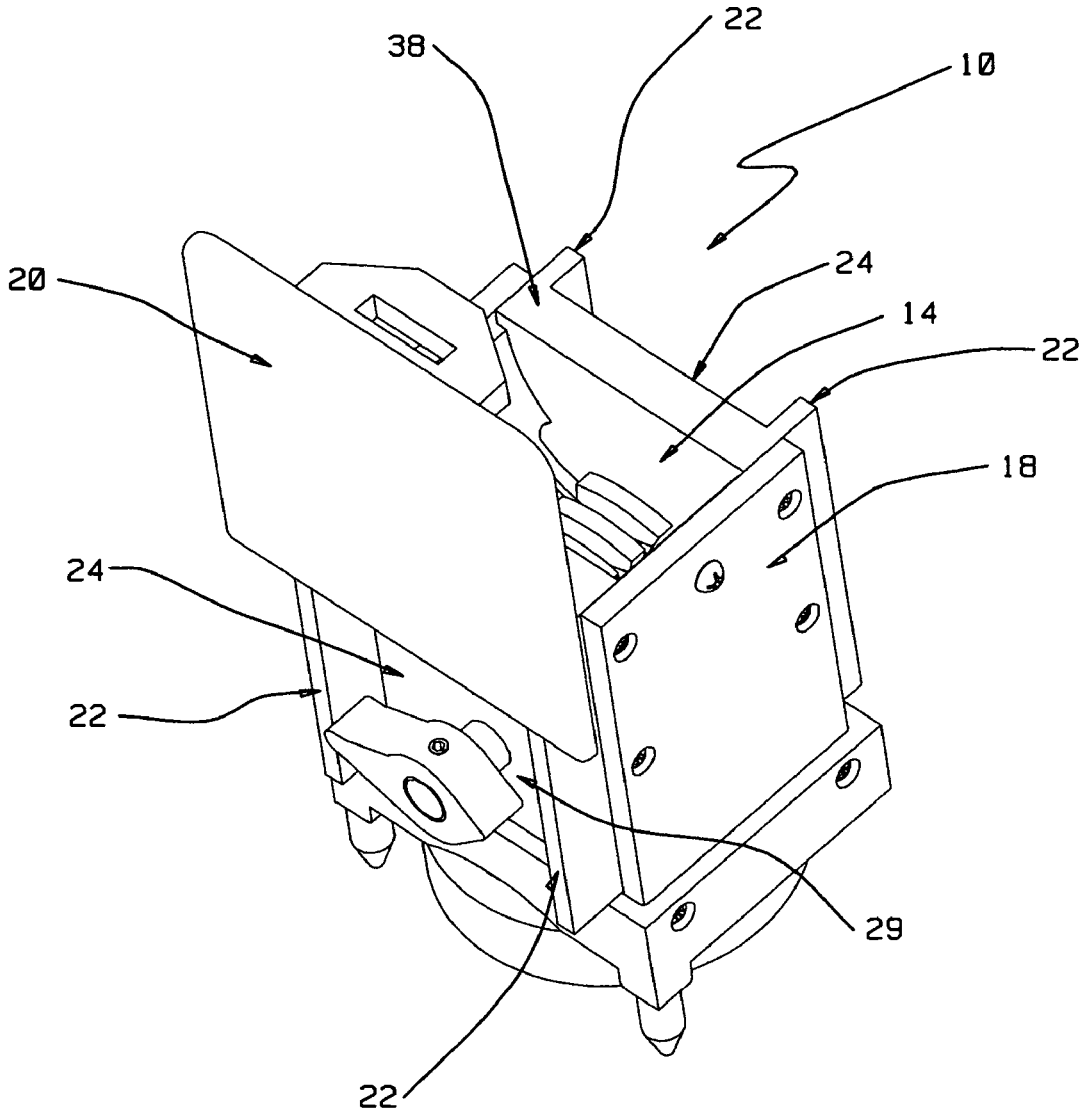
FIG. 2 is a three dimensional top perspective view of the pill crusher assembly.
Figure 4:
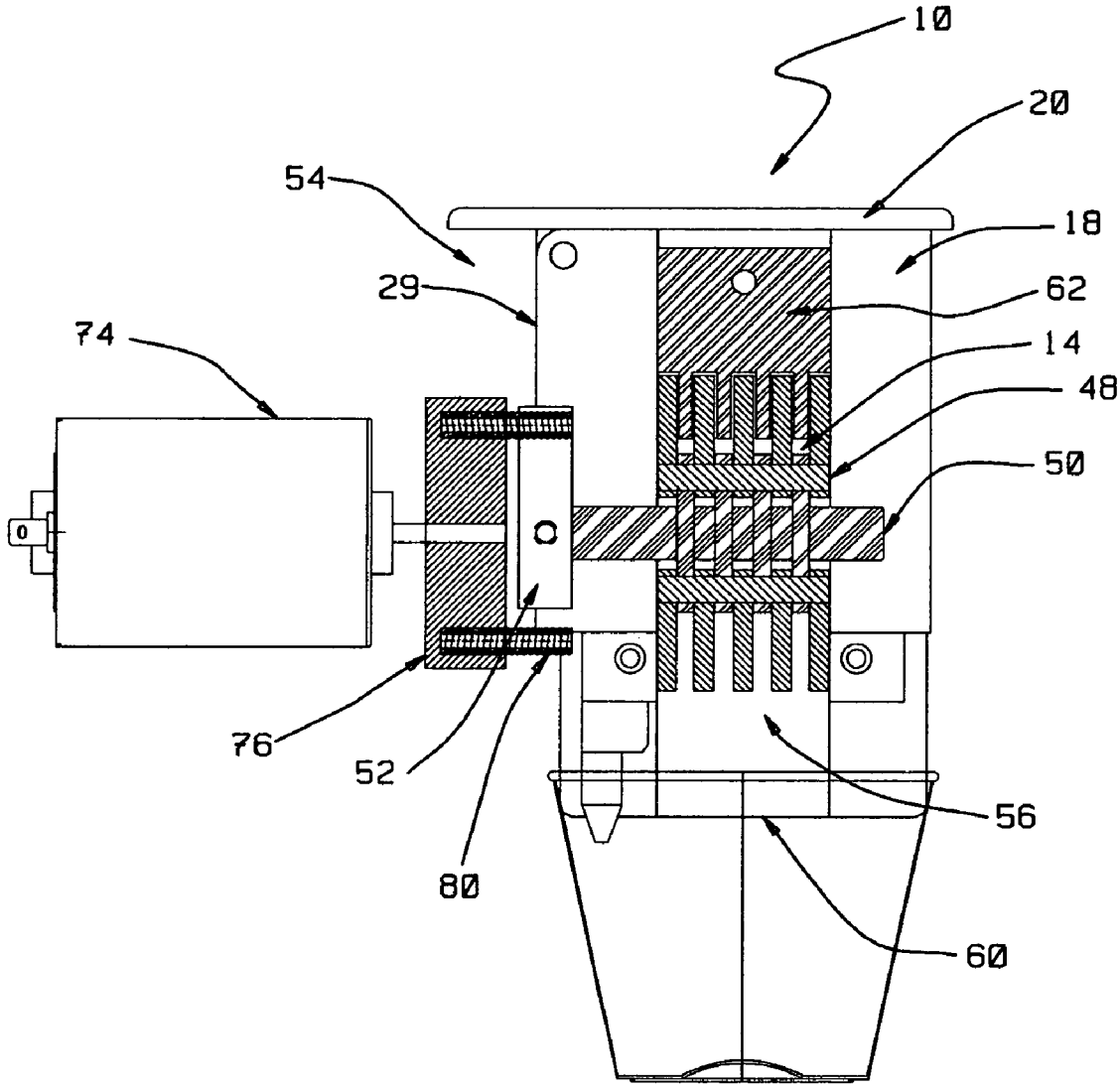
FIG. 4 is a front cross-sectional view of the pill crusher assembly with the collection bin affixed to the bottom of the pill crusher assembly. A motor and paddle engagement arm are shown to illustrate a functional operation technique.

Now referring to FIGS. 1, 2 and 4, the latching lid 20 is preferably attached to the inner sides of a set of guide ribs 22 on a hammer shaft drive paddle side 29. A retaining groove 30 is provided on a top surface 32 of the transportable housing 12 to keep the latching lid 20 in an upright position to allow for easy placement of pellets 16 in the hopper 14. An "O" ring 34 is provided on an under surface 36 of the latching lid 20 to assist in sealing the latching lid 20 to the hopper 14 while the invention is in operation. The "O" ring 34 is preferably formed to coincide with an upper hopper perimeter 38 and is made of a polymer type material that acts to reduce vibrational noises and ensure that flying residue from the pill crushing operation does not exit through the top surface 32 of the transportable housing 12.

Figure 3:
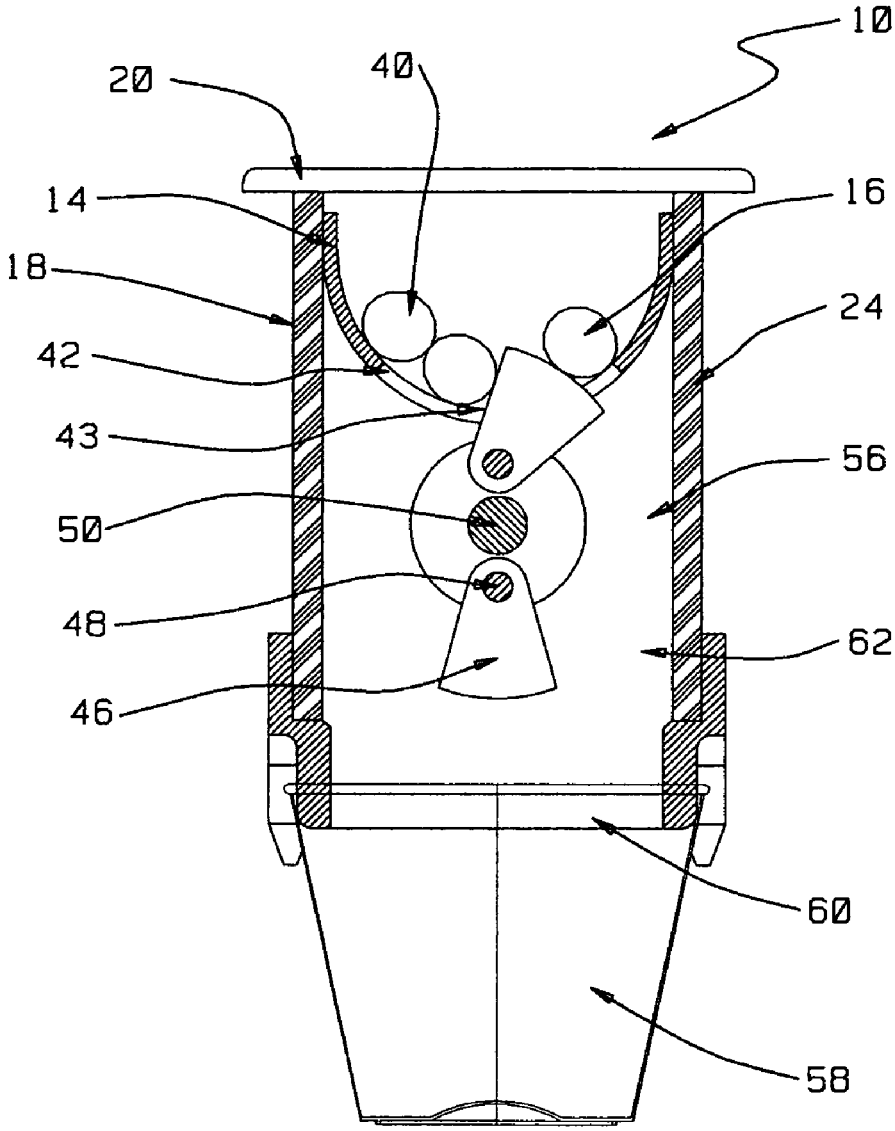
FIG. 3 is a side cross-sectional view of the pill crusher assembly with multiple pellets or pills in a hopper and a collection bin affixed to the bottom of the pill crusher assembly.
Figure 5:
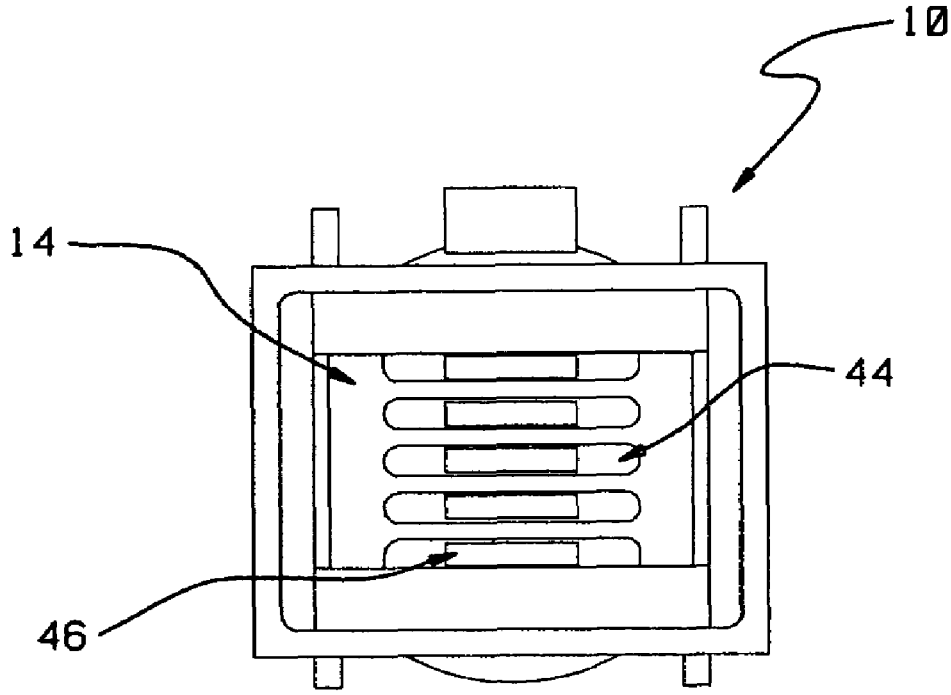
FIG. 5 is a top perspective view of the pill crusher assembly without a latching lid.

Now referring to FIGS. 3 and 5, the hopper 14 is preferably supportable to a plurality of standard-sized swallowable tablets 40. However, the hopper 14 may be configured to support larger pills or pellets 16 that would be suitable for animals. A concave configuration of a hopper floor 42 is the most preferred design to ensure that the pellets 16 and any large remaining particles are directed to a central, low point 43 within the hopper 14. The hopper 14 is thus preferably provided with an at least one gap 44 for accommodating an at least one striking hammer 46. The at least one gap 44 is sufficiently narrow such that the pellets 16 and unacceptably large particles in the hopper 14 are supported. The narrowness of the at least one gap 44 may be adjusted as desired depending on the fineness the grinds need to be for a particular use. The at least one gap 44 is therefore of sufficient width to allow the grinds to seep through.

The pill crusher assembly 10 is provided with a means of grinding the pellets 16 while the pellets 16 reside in the hopper 14. The means of grinding the pellets 16 transforms the pellets 16 and unacceptably large particles into grinds or a residue (not shown) with a pivotal striking action originating outside of the hopper 14. In the preferred embodiment, the means of grinding the pellets 16 is provided by the at least one striking hammer 46 positioned to strike the pellets 16 when rotated through the hopper 14.

Now referring to FIGS. 3 and 4, in the most preferred embodiment, an opposing pair of the at least one striking hammer 46 are pivotally supported on an at least one hammer retaining pin 48. The at least one striking hammer 46 is pivotal on the at least one hammer retaining pin 48 such that the at least one striking hammer 46 gives under stress. The pivotal design prevents the at least one striking hammer 46 from becoming jammed in the event the pellets 16 do not break apart (as shown in FIG. 3). A hammer shaft 50 mechanically rotates the at least one hammer retaining pin 48 so that the at least one striking hammer 46 strikes the pellets 16 residing on or near the hopper floor 42. A hammer shaft drive paddle 52 is fixedly connected to the hammer shaft 50 on an exterior area 54 of the at least one bearing plate 24 of the hammer shaft drive paddle side 29. The hammer shaft drive paddle 52, when set in motion, rotates the hammer shaft 50 that in turn rotates the at least one hammer retaining pin 48 moving the at least one striking hammer 46 rotationally.

A shaft 56 for transporting the grinds from the hopper 14 to a collection bin 58 is also provided. The collection bin 58 is located at a bottom end 60 of the shaft 56 where the grinds are collectable within. When the collection bin 58 is placed on the bottom end 60 of the shaft 56, a confined region 62 is created between the latching lid 20, the shaft 56 and the collection bin 58. The confined region 62 is enclosed such that the grinds are inescapable from the confined region 62 during operational usage.

Figure 6:
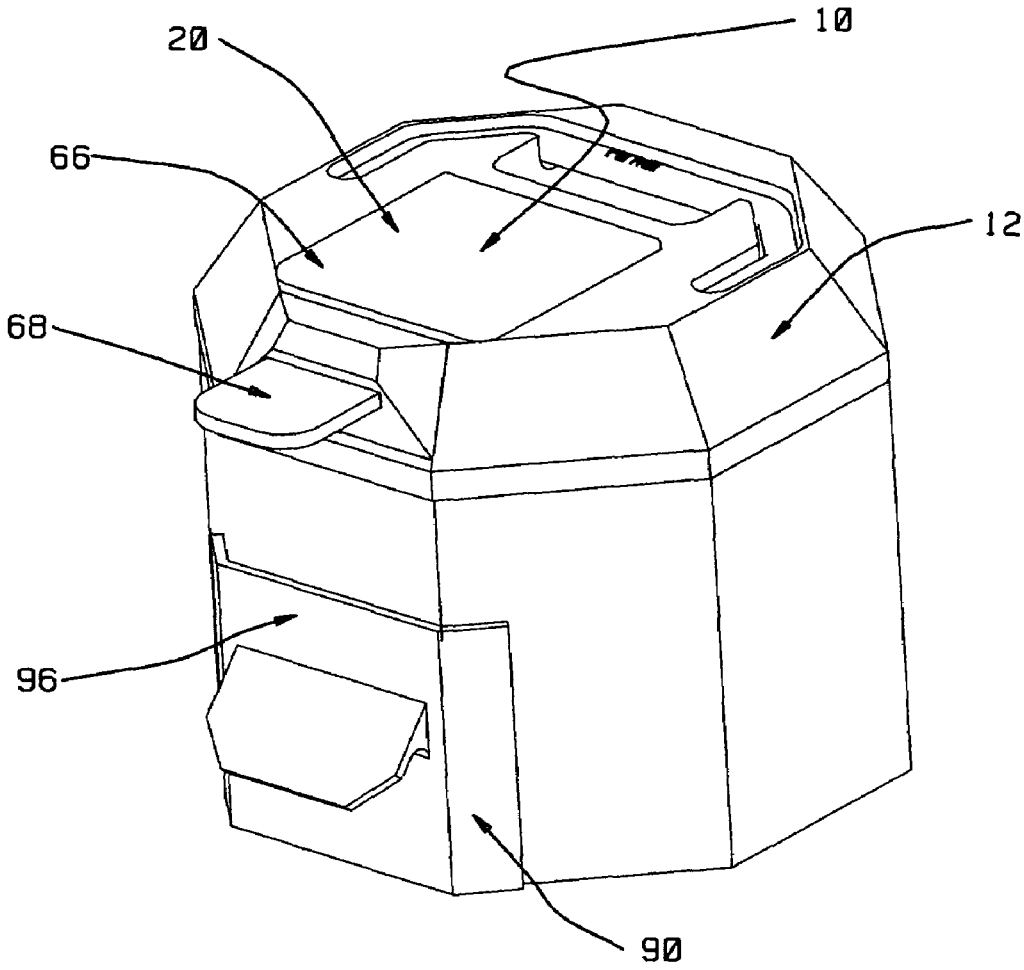
FIG. 6 is a frontal three-dimensional view of the transportable housing and the pill crusher assembly in a secured position.
Figure 8:
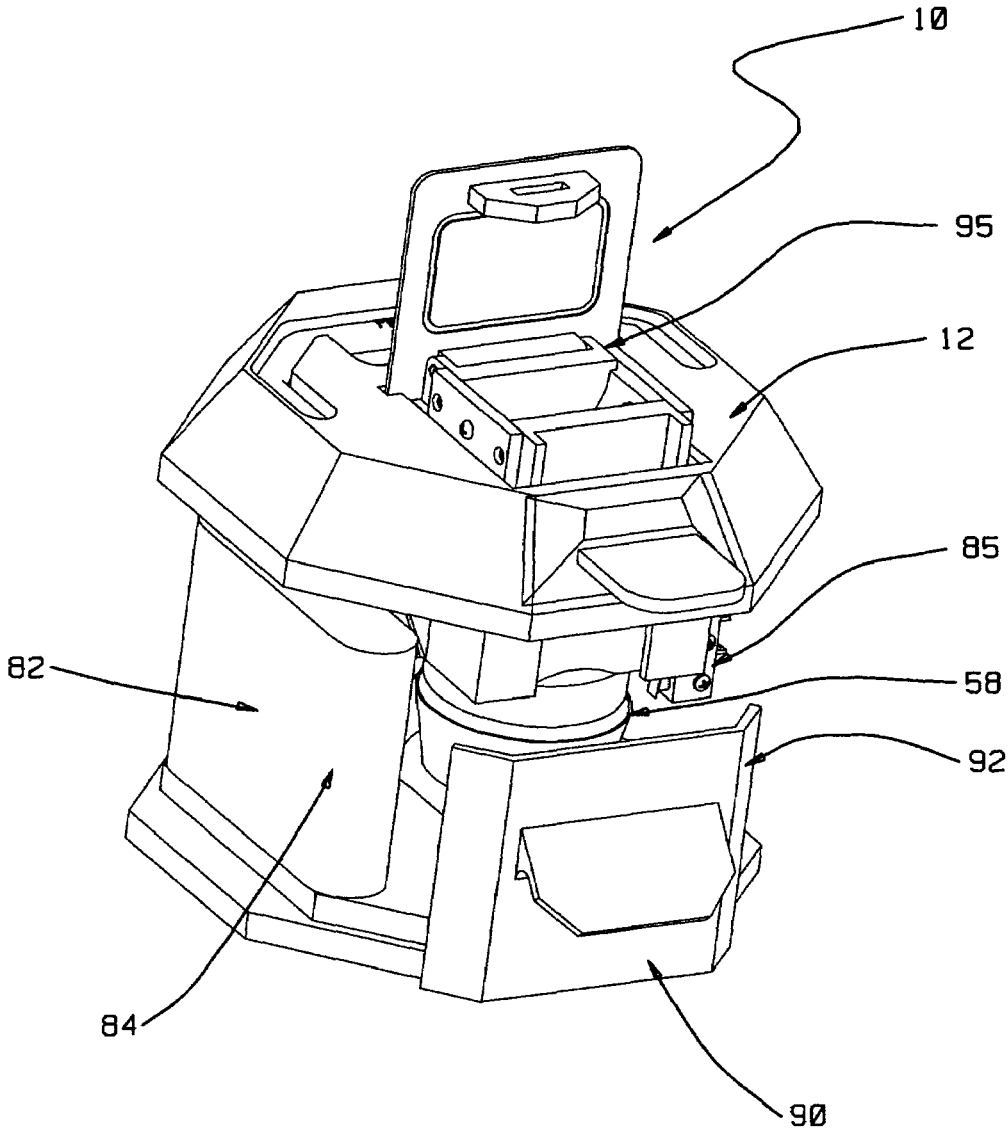
FIG. 8 is a broken-up frontal view of the transportable housing revealing the pill crusher assembly and a power supply.

Now referring to FIGS. 1, 6 and 8, the transportable housing 12 is provided to preferably include an electrical power source 63 to operate the pill crusher assembly 10. It is also appreciated that a manual means of operating the pill crusher assembly 10 may also be provided by the transportable housing 12 with a lever or like device not shown. The hopper 14 of the pill crusher assembly 10 is made to be positionable inside the transportable housing 12 for receiving pellets 16. The transportable housing 12 is optionally provided with a carrying handle 64 for easy hauling. In the preferred embodiment, the carrying handle 64 is situated on the top surface 32 of the transportable housing 12 and is pivotal so as to not obstruct the pill crusher assembly 10.

Figure 7:
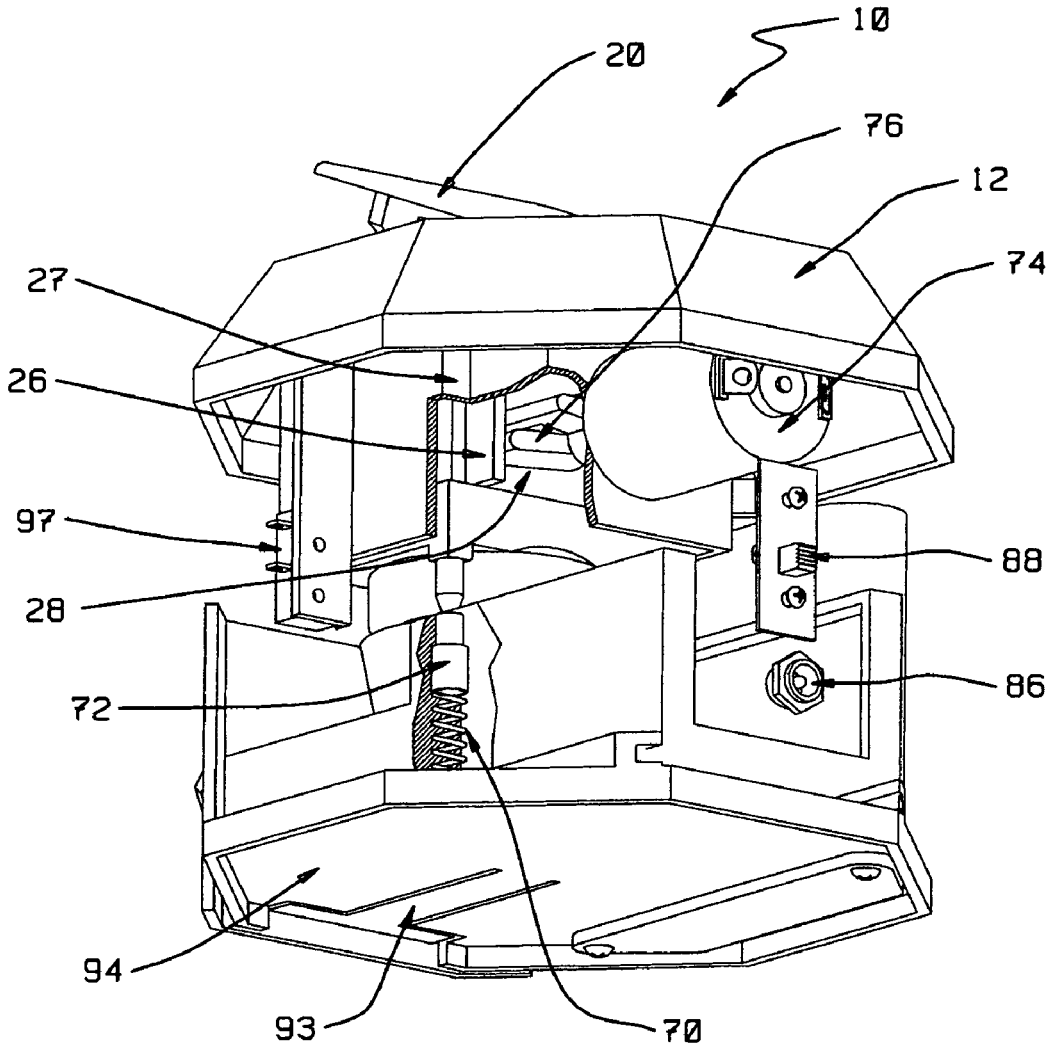
FIG. 7 is a broken-up rear view of the transportable housing revealing the pill crusher assembly and a motor.

Now referring to FIGS. 1, 6 and 7, the latching lid 20 preferably sits flush with the top surface 32 of the transportable housing 12 when the latching lid 20 resides in a secured position 66. To place the latching lid 20 in the secured position 66, the latching lid 20 is closed and then pressed gently down so that a latch release lever 68 is triggered to lock the pill crusher assembly 10 and the latching lid 20 into the secured position 66. After operational usage, the latching lid 20 is releasable from the secured position 66 by pressing the latch release lever 68 to disengage the pill crusher assembly 10. In the preferred embodiment, the pill crusher assembly 10 is forced in an upward direction by a plunger spring 70 when the latch release lever 68 is pressed to allow the pill crusher assembly 10 to be more easily accessible for removal. The plunger spring 70 is coupled with a plunger 72 to receive the pill crusher assembly 10. In the most preferred embodiment, two plunger springs 70 are positioned on opposite sides of the crusher assembly receiving cavity 28.

Now referring to FIGS. 3, 4, 6 and 7, the means of grinding the pellets 16 is preferably propelled by a motor 74 located in the transportable housing 12. The motor 74 is situated to easily drive a paddle engagement arm 76 in a rotational manner and is sufficiently small to keep the size of the transportable housing 12 portable for easy carrying. The paddle engagement arm 76 is situated in the pill crusher assembly receiving cavity 28 of the transportable housing 12. The paddle engagement arm 76 protrudes outwardly into the pill crusher assembly receiving cavity 28 to be engagable with hammer shaft drive paddle 52 when the pill crusher assembly 10 is in the secured position 66. An at least one outward extension 80 of the paddle engagement arm 76 is preferably used to engage the hammer shaft drive paddle 52 to drive the hammer shaft drive paddle 52 in a rotational manner. In the most preferred embodiment, the at least one outward extension 80 is made of a compression spring to allow easy receiving or releasing of the pill crusher assembly 10 in the event that the paddle engagement arm 76 rests vertically to impede an upward or downward movement of the hammer shaft drive paddle 52.

Now referring to FIGS. 7 and 8, the motor 74 is preferably powered by a rechargeable power supply 82 for easy transportable usage. In an alternative embodiment, a direct power supply (not shown) from an external power source may also be used to minimize manufacturing costs by eliminating the need for the rechargeable power supply 82. In the most preferred embodiment, the rechargeable power supply 82 consists of a battery pack 84 that can store energy for several days and operate continuously for several hours. The rechargeable power supply 82 would need to occasionally be resupplied with power using an external power source. The external power source would feed the rechargeable power supply 82 or the motor directly through a power input socket 86. The power input socket 86 would then direct the power to go directly to the motor 74 or rechargeable power supply 82 depending on which design is being used. An on-off switch 88 that triggers power to be directed to the motor 74 is further provided to allow simple operation of the pill crusher assembly 10.

Now referring to FIGS. 6 and 8, a collection bin drawer 90 is located at a lower end 92 of the transportable housing 12 for accessing the collection bin 58. When the pill crusher assembly 10 is ready to crush or grind the pellets 16, the collection bin 58 is placed into the collection bin drawer 90. The collection bin drawer 90 is then closed so that the collection bin 58 is situated to be receivable to the bottom end 60 of the shaft 56 when the pill crusher assembly 10 is placed in the secured position 66. A release spring 93 is optionally molded into a lower support plate 94 to provide an easy means of opening the collection bin drawer 90 when the latch release lever 68 is pressed.

In an optional embodiment, a safety mechanism 85 is provided that restricts operational usage of the pill crusher assembly 10 when the pill crusher assembly 10 is in a disengaged position 95. When collection bin drawer 90 is moved to a closed position 96, the pill crusher assembly 10 is moveable to the secured position 66. Once the pill crusher assembly 10 is in the secured position 66, a microswitch 97 is activated creating a closed circuit for power to be delivered to the motor 74. The pill crusher assembly 10 is made operational by adjusting the on-off switch 88 to the on position. After operational usage, the collection bin drawer 90 is openable only after the latch release lever 68 has been pressed and the pill crusher assembly 10 is disengaged with the paddle engagement arm 76. Requiring the latch release lever 68 to be pressed first prevents the collection bin drawer 90 from accidentally opening while the pellets 16 or pills are still being grinded.

While a particular embodiment of the present pill crusher assembly has been described herein, it will be appreciated by those skilled in the art that changes and modifications may be made thereto without departing from the invention in its broader aspects and as set forth in the following claims.

The invention claimed is:

1. A pill crusher assembly for grinding pellets into grinds, the pill crusher assembly comprising:

a transportable housing provided with a pill crusher assembly receiving cavity, receiving a removable pill crusher unit and further provided with a latching lid;

said removable pill crusher unit comprises of a hopper for receiving pellets wherein said latching lid secures the pellets in said hopper during operational usage and a plurality of guide ribs on an exterior of at least one bearing plate of said removable pill crusher unit ensuring accurate positioning of the removable pill crusher unit in the transportable housing; and said removable pill crusher unit further comprises of at least one striking hammer for grinding the pellets while the pellets reside in said hopper wherein said at least one striking hammer is pivotally supported on a hammer shaft and transforms the pellets into grinds with a striking action.

2. The pill crusher assembly of claim 1, wherein said hopper is supportable to a plurality of swallowable pellets suitable for human consumption.

3. The pill crusher assembly of claim 1, wherein said hopper is provided with an at least one gap for accommodating said at least one striking hammer.

4. The pill crusher assembly of claim 3, wherein said at least one gap is sufficiently narrow such that the pellets in said hopper are supported.

5. The pill crusher assembly of claim 3, wherein said at least one gap is of sufficient width to allow the grinds to seep through.

6. The pill crusher assembly of claim 1, wherein said latching lid is provided with an "O" ring for sealing said latching lid to said hopper.

7. The pill crusher assembly of claim 1, wherein said at least one striking hammer is positioned to strike the pellets when rotated through said hopper.

8. The pill crusher assembly of claim 7, wherein said at least one striking hammer is supported on a hammer retaining pin such that said at least one striking hammer gives under stress when striking the pellets.

9. The pill crusher assembly of claim 7, wherein said at least one striking hammer is propelled by a motor located in said transportable housing.

10. The pill crusher assembly of claim 9, wherein said motor drives a paddle engagement arm in a rotational manner, said paddle engagement arm is situated in said pill crusher assembly receiving cavity of the transportable housing.

11. The pill crusher assembly of claim 10, wherein said paddle engagement arm drives a hammer shaft drive paddle located on an exterior area to said at least one bearing plate, said hammer shaft drive paddle is fixedly connected to a hammer shaft.

12. The pill crusher assembly of claim 11, wherein said hammer shaft mechanically rotates an at least one hammer retaining pin, wherein said at least one hammer retaining pin resides on said hammer shaft and directly supports the pivotal action of said at least one striking hammer.

13. The pill crusher assembly of claim 9, wherein said motor is powered by a rechargeable power supply.

14. The pill crusher assembly of claim 9, wherein said motor is powered by a direct power supply from an external power source.

15. The pill crusher assembly of claim 1, wherein a shaft located in a operational relationship to said hopper is further provided and extends to an external location away from said hopper.

16. The pill crusher assembly of claim 1, wherein said transportable housing is further provided with a carrying handle for easy hauling.

17. The pi1l crusher assembly of claim 1, wherein said latching lid is releasable from a secured position by a latch release lever.

18. A pill crusher assembly for grinding pellets into grinds, the pill crusher assembly comprising:

a transportable housing provided with a pill crusher assembly receiving cavity, receiving a removable pill crusher unit and further provided with a latching lid;

said removable pill crusher unit comprises of a hopper for receiving pellets wherein said latching lid secures the pellets in said hopper during operational usage and a plurality of guide ribs on the interior of said pill crusher assembly receiving cavity provides an easy means for sliding the removable pill crusher unit in and out of the pill crusher assembly receiving cavity said removable pill crusher unit further comprises of at least one striking hammer for grinding the pellets while the pellets reside in said hopper wherein said at least one striking hammer is pivotally supported on a hammer shaft and transforms the pellets into grinds with a striking action.

* * * * *